US005218410A

United States Patent [19]

Nakabayashi et al.

[11] Patent Number: 5,218,410

[45] Date of Patent: Jun. 8, 1993

[54] CLEANING ROLL MATERIAL AND FIXING APPARATUS

[75] Inventors: Akiro Nakabayashi, Urawa; Kenji Maeda, Osaka, both of Japan

[73] Assignees: Mitsubishi Materials Corporation, Tokyo; Kanai Juyo Kogyo Co., Ltd., Itami, both of Japan

[21] Appl. No.: 767,470

[22] Filed: Sep. 30, 1991

[30] Foreign Application Priority Data

Dec. 29, 1990 [JP] Japan ..... 2-416028

[51] Int. Cl.[5] ..... G03G 15/20

[52] U.S. Cl. ..... 355/283; 355/284; 15/209.1

[58] Field of Search ..... 355/283, 284, 300, 290; 428/379, 400, 389, 288; 118/104; 15/209 C, 104.93

[56] References Cited

U.S. PATENT DOCUMENTS

| | | | |
|---|---|---|---|
| 4,309,957 | 1/1982 | Swift | 118/60 |
| 4,686,132 | 8/1987 | Sumii et al. | 428/288 X |
| 4,751,548 | 6/1988 | Lawson | 355/284 |

FOREIGN PATENT DOCUMENTS

| | | | |
|---|---|---|---|
| 60-129768 | 7/1985 | Japan | 355/284 |
| 61-55677 | 3/1986 | Japan | 355/283 |
| 1-173085 | 7/1989 | Japan | 355/283 |

*Primary Examiner*—Pendegrass Joan H.
*Attorney, Agent, or Firm*—Fish & Richardson

[57] ABSTRACT

In order to reliably clean a thermal fixing roll for fixing a non-fixed image in an image forming apparatus such as a copier or a laser beam printer, a non-woven fabric web having a crisscross structure or a parallel structure with a thermally bonded fiber sheet is disposed at least on the side in contact with the fixing roll. The thermally bonded fiber sheet comprises composite fibers including 5 to 70% by weight of electroless nickel plated 'CONEX' fibers, which is obtained by depositing metallic nickel to a thickness of up to and including 0.2 μm by an electroless plating method on 'CONEX' fibers which have the surface formed with stripe-like grooves, macrovoids, fine irregularities or a modified cross-section and is heat-resistant and excellent in adhesion for nickel, in addition to non-plated 'CONEX' fibers and undrawn polyester fibers. Preferably, the above non-fabric web is impregnated with a heat-resistant cationic charging agent as a cleaning roll material.

6 Claims, 3 Drawing Sheets

PRIOR ART

CLEANING ROLL MATERIAL AND FIXING APPARATUS

BACKGROUND OF THE INVENTION

1. Field of the Invention

This invention relates to a cleaning roll material in contact with a thermal fixing roll and a fixing apparatus, for the purpose of fixing non-fixed images in an image forming apparatus such as a copier or a laser beam printer.

2. Description of the Prior Art

Cleaning roll materials have been proposed for cleaning thermal fixing rolls in a copier or a laser beam printer with a non-woven fabric web of cellulosic fibers in contact with the fixing rolls.

However, when the fixing roll surface becomes coarser, the releasing property of the roll deteriorates, increasing the adhesion of the fixing roll surface and toner to each other, and finally causing problems in which toner can no longer be perfectly removed.

To solve these problems, it is proposed to use a fiber cleaning material web containing abrasive particles on the side in contact with the fixing roll, as disclosed in Japanese unexamined laid open patent application (Tokkai) No. 173085/1989. The abrasive particles attached to such cleaning material web have weak adhesion to the web, and during cleaning of the fixing rollers, they are detached and serve as an abrasive with respect to the fixing roll to remove the toner layer firmly attached to the fixing roll. Thus, good cleaning can be obtained.

However, the detached abrasive particles, which provide for the high cleaning property, can not be perfectly recovered in the web. These particles remain attached to the fixing roll surface to be re-attached to and contaminate copying paper.

SUMMURY OF THE INVENTION

The present invention has been developed in order to solve the above problems; A cleaning roll material according to the present invention has the following construction:

A cleaning roll material for cleaning the surface of a fixing roll of a toner image forming apparatus, said cleaning roll material comprising a thermally bonded fabric sheet having a parallel fiber arrangement structure, including at least electroless plated heat-resistant synthetic fibers obtained by providing electroless plating on heat-resistant synthetic fibers having a surface formed with longitudinal stripe-like grooves, macrovoids, fine irregularities or a modified cross-section and undrawn synthetic fibers.

Another aspect of this invention constitutes a cleaning roll material for cleaning the surface of a fixing roll of a toner image forming apparatus, said cleaning roll material comprising a thermally bonded fabric sheet having a crisscross structure as a lamination of a parallel web and a cross web, the cross web side serving to wipe away the surface of the fixing roll, including at least electroless plated heat-resistant synthetic fibers obtained by providing electroless plating on heat-resistant synthetic fibers having a surface formed with longitudinal stripe-like grooves, macrovoids, fine irregularities or a modified cross-section and undrawn synthetic fibers.

Another aspect of this invention constitutes a cleaning roll material for cleaning the surface of a fixing roll of a toner image forming apparatus, said cleaning roll material comprising a thermally bonded fabric sheet having a crisscross structure as a lamination of a cross web having fiber webs in cross arrangement and a parallel web having fibers in parallel arrangement. The cross web side of the fabric sheet is held in contact with the fixing roll comprised of a mixed fiber web including 5 to 70% by weight of electroless plated heat-resistant synthetic fibers obtained by providing an electroless plating layer up to and including 0.2 μm in thickness on the surface of heat-resistant synthetic fibers having a surface formed with longitudinal stripe-like grooves, macrovoids, fine irregularities or a modified cross-section, non-plated heat-resistant synthetic fibers and undrawn synthetic fibers. The parallel web side of the fabric sheet is comprised of non-plated heat-resistant synthetic fibers and undrawn synthetic fibers.

Another aspect of this invention constitutes a cleaning roll material comprising a thermally bonded fabric sheet having a crisscross structure as a lamination of a parallel web and a cross web. The cross web side is comprised of 5 to 70% by weight of electroless plated heat-resistant synthetic fibers obtained by providing a metal layer up to and including 0.2 μm in thickness on the surface of heat-resistant synthetic fibers having a surface formed with stripe-like grooves, macrovoids, fine irregularities or a modified cross-section, 0 to 75% by weight of non-plated heat-resistant synthetic fibers and up to and including 40% by weight of undrawn synthetic fibers. The parallel web side is comprised of 20 to 60% by weight of non-plated heat-resistant fibers having a surface formed with stripe-like grooves, fine irregularities or a modified cross-section, and 40 to 80% by weight of undrawn synthetic fibers, where the mixture ratio of undrawn synthetic fibers in the cross web side to undrawn synthetic fibers in the parallel web side is 1 to between 1.5 and 2.0.

It is preferable in the above aspects of the invention that a predetermined amount of a heat-resistant cationic charging agent is attached to the cleaning roll material.

It is preferable in the above aspects of the invention that the cleaning roll material is impregnated with 3 to 40 g/m$^2$ of silicone oil with a viscosity of 3,000 to 30,000 centistokes or is impregnated with a mixture of the silicone oil and a heat-resistant cationic charging agent.

A fixing apparatus according to the present invention has the following construction.

A fixing apparatus comprising a heat roll and a backup roll in a toner image forming apparatus, where a first cleaning roll comprising the cleaning roll material, as noted above, wound around a core member is in contact with the heat roll, and a second cleaning roll comprising a cleaning roll material of a thermally bonded fabric sheet composed of non-plated heat-resistant synthetic fibers and undrawn synthetic fibers being wound around a core member is in contact with the backup roll.

According to the invention, toner attached to the fixing roll can be removed efficiently and substantially completely. Particularly, a superior stripping effect can be obtained with an image forming apparatus using plural toners, such as full color copiers, and full color printers where high cleaning effects are required compared to a monochromatic copier.

DESCRIPTION OF THE PREFERRED EMBODIMENTS

Now the composition of the invention will be described.

The cleaning roll material, according to the invention, comprises heat-resistant synthetic fibers having the surface formed with stripe-like grooves, macrovoids or having a modified cross section such as aromatic polyamide, aromatic polyester, 4-6 Nylon, polyphenylene sulfide (PPS), polyethylene terephthalate (PET), polyamide-imide (PAI), carbon, phenol, pre-carbon fibers, fire resistance fibers, polybenzimidazole (PBI) and 'CONEX' fibers ( a trademark of Teijin Co., meta-aramid fibers).

Figure 1:
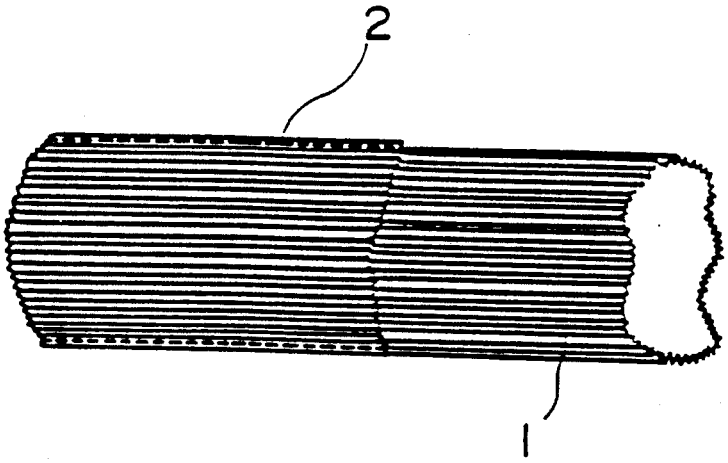
FIG. 1 is a schematic perspective view showing an electroless nickel plated 'CONEX' fiber (a trademark of Teijin Co., meta-aramid fiber) used in accordance with the invention.

FIG. 1 shows an example of 'CONEX' fiber, which is electroless plated having a surface formed with fine stripe-like grooves extending in the longitudinal direction and clad in the shape of dendrite with about 20 to 30% by weight of a metal 2 selected from a group consisting of nickel, copper, gold, silver, cobalt and alloys of these metals (typically nickel) plated in a layer up to and including 0.2 μm in thickness by an electroless plating method.

These fibers are combined in a predetermined amount, for instance 5 to 70% by weight, into a crisscross web structure or a parallel web structure and incorporated into a fiber web of a thermally bonded fabric sheet at least in the side in contact with a fixing roll, thus forming a cleaning roll material.

If the mixing amount of the electroless plated heat-resistant synthetic fibers exceeds 70% by weight, it leads to undesirable high cost and reduction of mechanical strength. If the amount is less than 5% by weight, on the other hand, the expected effects can not be obtained.

The heat-resistant synthetic fibers with the surface having stripe-like grooves or macrovoids are thrust with the metal layer 2 in close contact into the concave grooves 1 formed on the surface of the 'CONEX' fiber. So, by frictional force, the metal plating layer 2 with the irregular surface adhering firmly to the fiber surface in a dendritic form has a function of mechanically stripping toners which are firmly adhering to the fixing roll surface. If the plating thickness exceeds 0.2 μm, the adhesive strength of the plating layer is reduced, and the plating layer is liable to separate and remain on the fixing roll surface. Therefore, the maximum thickness of the plating layer is preferably 0.2 μm.

Figure 2:
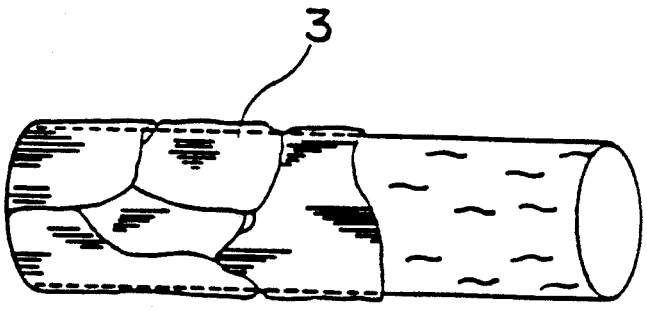
FIG. 2 is a schematic perspective view showing a prior art nickel plated aromatic polyamide fiber.

Further, the reason why the 'CONEX' fibers are used as non-plated fibers is that their surface has many fine stripe-like grooves extending in the longitudinal direction. The metal layer wedges into the grooves and is thus firmly attaches to the fiber surface in closely contact in a dendritic form. The fibers have a powerful ability to strip toners as a result of the stripe-like irregularities of the fibers. In addition to the 'CONEX' fiber, other heat-resistant synthetic fibers having a modified cross-section such as petal-type, star, scale-provision-type, thick-and-thin, triangular, Y-type, cross type and others also have similar stripping ability and can be used. Other heat-resistant synthetic fibers, for instance 'KEVLAR' fiber or 'NOMEX' fiber (each trademark of DuPont Co.), have less stripe-like grooves or macrovoids, as shown in FIG. 2. Therefore, the metal plating layer 3 has poor adhesion, and its cracking and detachment are an undesirable possibility.

Such fibers constituting the cleaning roll material, other than the electroless plated heat-resistant synthetic fibers, may be usable. Heat-resistant synthetic fibers having a fiber surface status similar to the non-plated heat-resistant synthetic fibers, as noted above, such as 'CONEX' fibers and undrawn synthetic fibers, for instance, thermal bonding undrawn polyester fibers may be used. Undrawn fibers such as aromatic polyamide, 4-6 Nylon, polyphenylene sulfide (PPS), polyamide-imide (PAI), polybenzimidazole (PBI) and aromatic polyester may be also used.

Where the crisscross structure is adopted, the parallel web side not in contact with the fixing roll is constructed of blended fibers comprising the non-plated heat-resistant synthetic fibers noted above and undrawn synthetic fibers having different fineness respectively, for instance 'CONEX' fibers and undrawn polyester fibers.

On the other hand, the toner is usually negatively charged in the developing step. While the toner is discharged in a subsequent step, it can not be completely discharged. Since the toner attached to the fixing roll in the fixing step is negatively charged, the toner can not be completely removed by mechanical stripping alone.

Accordingly, the cleaning roll material is positively charged by attaching a heat-resistant cationic charging agent to the fabric sheet comprised of the cleaning roll material other than heat-resistant synthetic fibers plated with metal by an electroless plating method. Thus the fabric sheet can electrostatically attract free toner on the fixing roll.

The toner removal effect may be further enhanced by adopting a crisscross structure as the fiber arrangement of the web constituting the cleaning roll material, which is a laminationof a parallel structure where fibers are arranged in one direction and a cross structure where fibers are arranged in two directions, and by having the cross structure, which offers higher frictional resistance, in contact with the side facing the fixing roll. In this case, it is economically advantageous to incorporate the above metal-clad fibers obtained by an electroless plating method into the cross structure alone.

Further, the fiber arrangement may consist of the sole parallel structure alone. In this case, the cleaning effect may be attained by using the above electroless plated heat-resistant synthetic fibers and providing a heat-resistant cationic charging agent.

In the above crisscross structure, the mixture ratio of undrawn fibers in the cross structure to undrawn fibers in the parallel structure is set at 1 to between 1.5 and 2.0. If the ratio exceeds 1 to 2.0, the wiping effect of the web in the cross structure may be reduced. If the ratio is less than 1 to 1.5, on the other hand, the mechanical strength of the cleaning roll material may be reduced.

According to the present invention, an excellent cleaning function can be attained efficiently in combination with electrostatic toner removal function with the frictional force obtained by the irregular surface of the metal layer coated in a dendritic form by an electroless method on the surface of heat-resistant synthetic fibers with the surface formed with stripe-like grooves, fine irregularities, macrovoids, or a modified cross-section, with a mechanical toner removal function of the crisscross structure of thermally bonded fabric sheet, and with positive charging of the fabric sheet with a heat-resistant cationic charging agent.

Now, examples and comparative examples of the invention will be described in detail with reference to the drawings.

EXAMPLE 1

Figure 3:
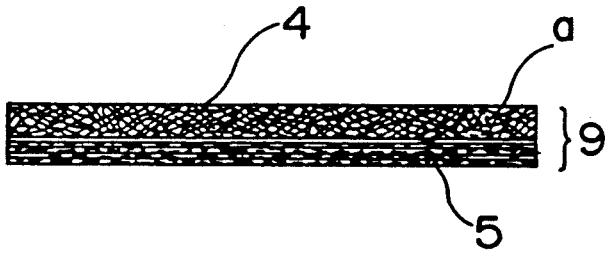
FIG. 3 is a schematic sectional view showing a cleaning roll material according to the invention.
Figure 4:
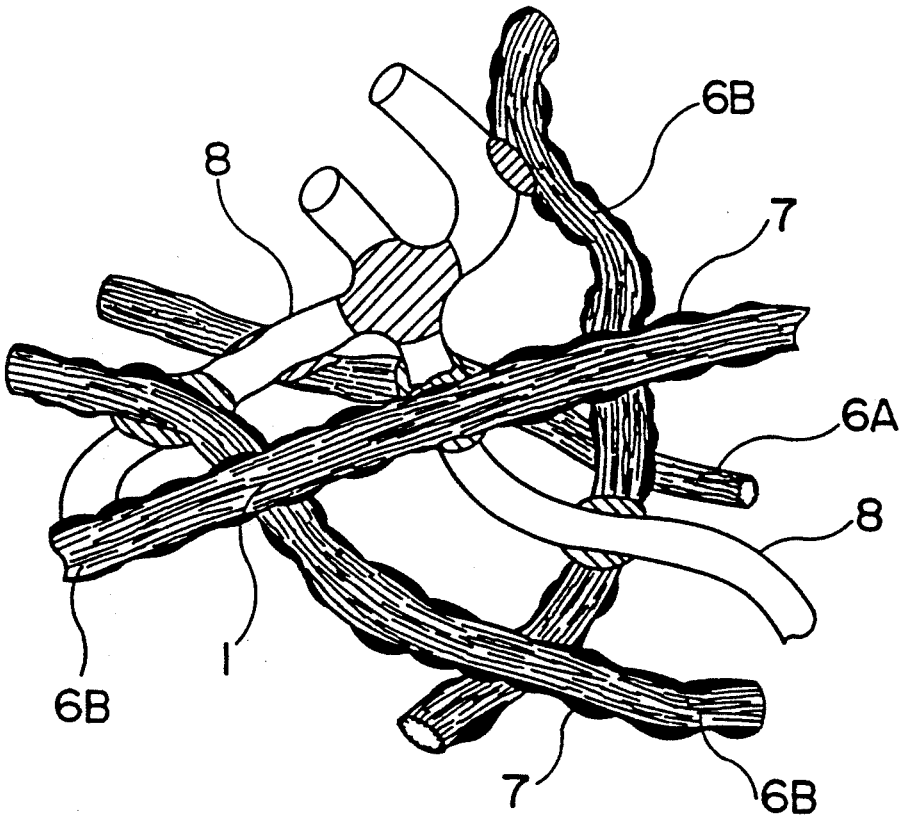
FIG. 4 is an enlarged-scale view showing a portion a in FIG. 3.

FIG. 3 is a schematic sectional view showing an example of the invention, and FIG. 4 is an enlargedscale view of portion a shown in FIG. 3.

The parallel web 5 was produced by opening and blending 40% by weight of non-plated heat-resistant synthetic fibers having many stripe-like grooves on the surface with a fineness of 1.25 deniers and a cut length of 38 mm, for instance 'CONEX' fibers (manufactured by Teijin Co.), and 60% by weight of undrawn polyester fibers (manufactured by TORAY Co.) with a fineness of 2.5 deniers and a cut length of 38 mm. The parallel web measured a weight of 14 g/m$^2$.

The cross web was produced by opening and blending 30% by weight of the above non-plated 'CONEX' fibers 6A with a fineness of 0.8 deniers and a cut length of 38 mm, 30% by weight of heat-resistant synthetic fibers having many stripe-like surface grooves coated with 30% by weight of metallic nickel 7 by an electroless plating method, for instance electroless nickel plated 'CONEX' fibers 6B coated in a dendritic form with a fineness of 1.25 deniers and a cut length of 38 mm and 40% by weight of undrawn polyester fibers 8 with a fineness of 2.5 deniers and a cut length of 38 mm. The cross web measured a weight of 13 g/m$^2$.

Then, as shown in FIGS. 3 and 4, the crisscross web formed by laminating the cross web 4 and the parallel web 5 was thermally pressed using a pair of flat rolls heated to 210° C. with a line pressure of 45 kg/cm to obtain a thermally bonded non-woven fabric sheet having a weight of 27 g/m$^2$ and a thickness of 50 μm. This non-woven fabric sheet was then impregnated with 1% by weight of fatty acid monoethanolamide as a heat-resistant charging agent, thus obtaining a cleaning roll material 9 having an electrostatic toner removal property.

EXAMPLE 2

The parallel web was produced by opening and blending 30% by weight of heat-resistant synthetic fibers having many stripe-like grooves on the surface and plated with 30% by weight of metallic nickel by an electroless plating method, for instance electroless nickel plated 'CONEX' fibers with a fineness of 1.25 deniers and a cut length of 38 mm obtained by plating 'CONEX' fibers in a dendritic form, 30% by weight of the above non-plated heat-resistant synthetic fibers with a fineness of 0.8 deniers and a cut length of 38 mm, for instance 'CONEX' fibers, and 40% by weight of undrawn polyester fibers with a fineness of 2.5 deniers and a cut length of 38 mm.

Then, the parallel web was thermally pressed using a pair of flat rolls heated to 200° C. with a line pressure of 45 kg/cm to obtain a thermally bonded non-woven fabric sheet with a weight of 27 g/m$^2$ and a thickness of 50 μm. This non-woven fabric sheet was then impregnated with 1% by weight of fatty acid monoethanolamide as a heat-resistant charging agent, thus obtaining a cleaning roll material having electrostatic toner removal ability.

EXAMPLE 3

The parallel web was produced by opening with a flat card machine and blending 20% by weight of non-plated heat-resistant synthetic fibers having many stripe-like grooves or macrovoids on the surface with a fineness of 1.25 deniers and a cut length of 38 mm, for instance 'CONEX' fibers (metha-aramide), 20% by weight of modified cross-section polyester fibers with a fineness of 1.5 deniers and a cut length of 38 mm and 60% by weight of undrawn polyester fibers with a fineness of 2.5 deniers and a cut length of 38 mm. The parallel web measured a weight of 14 g/m$^2$.

The cross web was produced by opening with a web forming machine and a cross lapping machine and blending 30% by weight of the above non-plated 'CONEX' fibers with a fineness of 0.8 deniers and a cut length of 38 mm, 30% by weight of electroless nickel plated polyphenylene sulfide (PPS) fibers with a fineness of 2 deniers and a cut length of 38 mm and 40% by weight of undrawn polyester fibers with a fineness of 2.5 deniers and a cut length of 38 mm. The cross web measured a weight of 13 g/m$^2$.

Then, the crisscross web was formed by laminating the cross web on the parallel web. The crisscross web was thermally pressed using a pair of flat rolls heated to 210° C. with a line pressure of 40 kg/cm, to obtain a thermally bonded composite non-woven fabric sheet with a weight of 27 g/m$^2$ and a thickness of 50 μm. The above non-woven fabric sheet was impregnated with a charging agent as in Example 1, thus obtaining a cleaning roll material.

EXAMPLE 4

The parallel web was produced by opening with a flat card machine and blending 20% by weight of non-plated 'CONEX' fibers having many stripe-like grooves on the surface with a fineness of 1.25 deniers and a cut length of 38 mm, 20% by weight of non-plated 4-6 Nylon fibers with a fineness of 2.0 deniers and a cut length of 38 mm and 60% by weight of undrawn polyester fibers with a fineness of 2.0 deniers and a cut length 38 mm. The parallel web measured a weight of 12 g/m$^2$.

The cross web was produced by opening with a card machine and a cross lapping machine and blending 30% by weight of electroless copper plated 4-6 Nylon fibers having a star-like sectional profile with a fineness of 2.0 deniers and a cut length of 38 mm, 30% by weight of non-plated 'CONEX' fibers having stripe-like grooves on the surface with a fineness of 0.8 deniers and a cut length of 38 mm and 40% by weight of undrawn polyester fibers with a fineness of 2.0 deniers and a cut length of 38 mm.

Then, the crisscross web was formed by laminating the cross web on the parallel web. The above crisscross web was thermally pressed using a pair of flat rolls heated to 210° C. with a line pressure of 40 kg/cm, to obtaine a thermally bonded non-woven fabric sheet with a weight of 27 g/m$^2$ and a thickness of 50 μm. The above non-woven fabric sheet was impregnated with fatty acid monoethanolamide charging agent as in Example 1, and then it was impregnated with a weight of 30 g/m$^2$ of silicone oil with a viscosity of 10,000 centistokes, thus obtaining a cleaning roll material.

EXAMPLE 5

Figure 5:
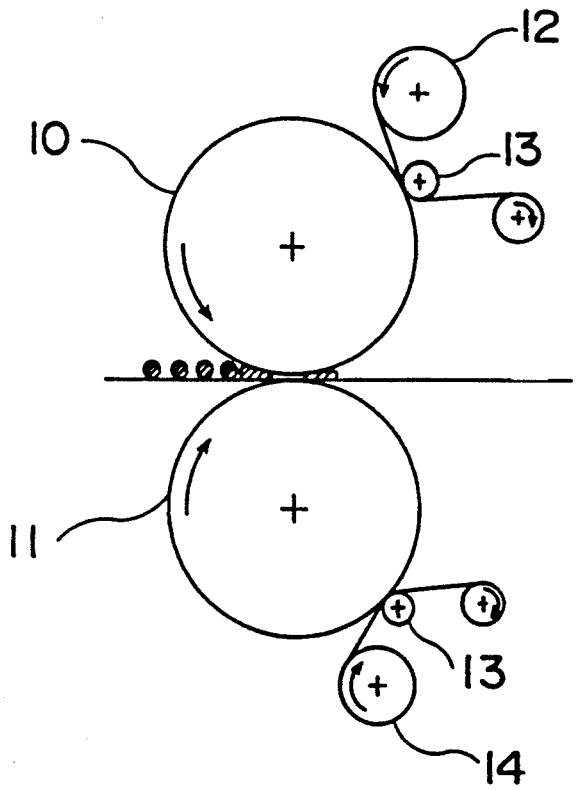
FIG. 5 is a schematic sectional view showing a fixing apparatus according to the invention.

FIG. 5 is a schematic sectional view of a toner image forming apparatus comprising fixing rolls which include a heat roll 10 and a backup roll 11.

One end of the cleaning roll 12, comprising the same cleaning roll material as in Example 1, which was wound around a core member with a predetermined length, was paid out and its cross web side was pressed against the heat roll by pressure roller 13.

Meanwhile, a non-plated cleaning roll material, pressed against the backup roll surface, was produced as follows: the parallel web having a weight of 25 g/m$^2$ was produced by opening with a flat card machine and blending 40% by weight of non-plated 'CONEX' fibers having many stripe-like grooves on the surface with a fineness of 1.25 deniers and a cut length of 38 mm and 60% by weight of undrawn polyester fibers with a fineness of 2.5 deniers and a cut length of 38 mm. It was then thermally pressed using a pair of flat rolls heated to 210° C. with a line pressure of 45 kg/cm to obtain a thermally bonded non-woven fabric sheet with a thickness of 45 μm. This non-woven fabric sheet was impregnated with a charging agent as in Example 1 to obtain the cleaning material.

The non-plated cleaning material which was wound around a core member with a predetermined length to obtain the non-plated cleaning roll 14. The cleaning roll 14 was pressed against the backup roll surface with the pressure roller 13.

A fixing apparatus according to the invention can be constructed as the foregoing.

COMPARATIVE EXAMPLE 1

A parallel web produced by opening and blending 60% by weight of non-plated 'NOMEX' fibers (manufactured by DuPont Co.) with a fineness of 1.5 deniers and a cut length of 38 mm, 40% by weight of undrawn polyester fibers with a fineness of 2.5 deniers and a cut length of 38 mm, and thermally pressed using a pair of flat rolls heated at 210° C. to obtain a thermally bonded non-woven fabric sheet with a weight of 27 g/m$^2$ and a thickness of 50 μm. Then, a fibrous cleaning roll material is obtained with 30% by weight of nickel plating based on a weight of the fiber through an electroplating after a pre-treatment.

COMPARATIVE EXAMPLE 2

A parallel web produced by opening and blending 60% by weight of non-plated 'CONEX' fibers (manufactured by Teijin Co.) with a fineness of 1.25 deniers and a cut length of 38 mm, 40% by weight of undrawn polyester fibers with a fineness of 2.5 deniers and a cut length of 38 mm, and thermally pressed using a pair of flat rolls heated to 210° C. with a line pressure of 45 kg/cm to obtain a cleaning roll material comprising thermally bonded non-woven fabric sheet with a weight of 27 g/m$^2$ and a thickness of 50 μm.

Table 1 shows cleaning performance data of the cleaning rolls made of the cleaning roll materials which were obtained in the Examples and the Comparative Examples as noted above.

COMPARATIVE EXAMPLE 3

A cleaning roll material as same as used in Comparative Example 2, which was impregnated with a weight of 30 g/m$^2$ of silicone oil with a viscosity of 10,000 centistokes, was wound around a core member with a predetermined length to obtain the cleaning roll.

The cleaning roll was provided on the upper side of the surface of the heat roll as noted in FIG. 5. The cleaning roll material paid out was pressed against the surface of the heat roll by pressure roller.

Meanwhile, another cleaning roll, which was wound around a core member with a predetermined length of a cleaning roll material as same as used in Comparative Example 2, was provided on the lower side of the surface of the backup roll. The cleaning roll material paid out was pressed against the surface of the backup roll by pressure roller.

TABLE 1

| | Samples | | | | | | | |
|---|---|---|---|---|---|---|---|---|
| measurement items | Ex. 1 | Ex. 2 | Ex. 3 | Ex. 4 | Ex. 5 | Comp. Ex. 1 | Comp. Ex. 2 | Comp. Ex. 3 |
| Fouling of fixing roll | 5 | 4 | 5 | 5 | 5 | 3 | 2 | 3 |
| Fouling of copy-image | 5 | 5 | 5 | 5 | 5 | 4 | 4 | 3 |
| Effect of cleaning | 5 | 4 | 5 | 5 | 5 | 3 | 2 | 3 |

The numerals in Table 1 indicate results of visual evaluations in five grades of the individual items after producing 10,000 copies with each cleaning roll mounted in a copier.

Table 2 shows measurement data of antistatic properties of the non-woven fabric sheets obtained in the Examples and the Comparative Examples as noted above.

TABLE 2

| | Samples | | | | | | |
|---|---|---|---|---|---|---|---|
| items | Ex. 1 | Ex. 2 | Ex. 3 | Ex. 4 | Ex. 5 | Comp. Ex. 1 | Comp. Ex. 2 |
| Voltages of frictional electrostatic charge (V) | | | | | | | |
| After 60 seconds | −20 | −24 | −25 | −40 | −30 | −105 | −980 |
| After 120 seconds | −28 | −32 | −30 | −50 | −35 | −131 | −1070 |

The numerical data shown in Table 2 was obained by the voltage of frictional electrostatic charge measurement method in JIS-L1094B. With the Examples 1 to 5 and Comparative Example 1, the negative charging is reduced compared to the Comparative Example 2 because of plating with nickel, copper, etc.

EFFECTS OF THE INVENTION

As has been described in the foregoing, with the structure according to the invention; the electroless plating layer is firmly attached in a dendritic form (i.e. non-uniformly) on the surface of 'CONEX' fibers having a modified cross-section. The plating surface is so irregular that toner attached to the fixing roll can be removed efficiently and substantially completely with mechanical stripping obtained by the frictional resistance between the surface of the cleaning roll material having cross web structure and fixing roll and electrostatic attraction provided by the incorporated charging agent.

Particularly, a very superior stripping effect can be obtained with an image forming apparatus using plural toners such as full color copiers and full color printers. Further, a full color copier uses four different toners, i.e., yellow, magenta, cyanogen and black toners respectively having different melting points, and plural toner layers which are thermally fused toners to mix the colors for the sake of reproducing colors close to those of the original.

Therefore, with the current fixing system, when a fixing temperature is constant, further attachment of toner to the fixing roll takes place. This means that the cleaning roll material according to the invention is particularly effective where high cleaning effects are required compared to a monochromatic copier.

Furthermore, by using a non-plated cleaning roll on the backup roll side of the fixing roll, it is possible to reliably remove the contamination transferred from the heat roll and to keep the fixing roll clean.

We claim:

1. A cleaning roll material for cleaning the surface of a fixing roll of a toner image forming apparatus, said cleaning roll material comprising a thermally bonded fabric sheet having a crisscross structure as a lamination of a parallel web and a cross web, the cross web side serving to wipe away the surface of the fixing roll, including at least electroless plated heat-resistant synthetic fibers obtained by providing an electroless plated metal layer of 0.2 μm or less in thickness on the heat-resistant synthetic fibers having a surface formed with longitudinal strip-like grooves, macrovoids, fine irregularities or a modified cross-section and undrawn synthetic fibers.

2. A cleaning roll material for cleaning the surface of a fixing roll of a toner image forming apparatus, said cleaning roll material comprising a thermally bonded fabric sheet having a crisscross structure as a lamination of a cross web having fibers in cross arrangement and a parallel web having fibers in parallel arrangement, the cross web side being held in contact with the fixing roll comprising a mixed fiber web including 5 to 70% by weight of electroless plated heat-resistant synthetic fibers obtained by providing an electroless plating layer up to and including 0.2 μm in thickness on the surface of heat-resistant synthetic fibers having a surface formed with longitudinal stripe-like grooves, macrovoids, fine irregularities or a modified cross-section, non-plated heat-resistant synthetic fibers and undrawn synthetic fibers, the parallel web side comprising non-plated heat-resistant synthetic fibers and undrawn synthetic fibers.

3. A cleaning roll material comprising a thermally bonded fabric sheet having a crisscross structure as a lamination of a parallel web and a cross web, the cross web side composed of 5 to 70% by weight of electroless plated heat-resistant synthetic fibers obtained by providing a metal layer up to and including 0.2 μm in thickness on the surface of heat-resistant synthetic fibers having a surface formed with stripe-like grooves, macrovoids, fine irregularities or a modified cross-section, 0 to 75% by weight of said non-plated heat-resistant synthetic fibers and up to and including 40% by weight of undrawn synthetic fibers, the parallel web side composed of 20 to 60% by weight of non-plated heat-resistant fibers having a surface formed with stripe-like grooves, macrovoids, fine irregularities or a modified cross-section, and 40 to 80% by weight of undrawn synthetic fibers, where the mixture ratio of undrawn synthetic fibers in the cross web side to undrawn synthetic fibers in the parallel web side is 1 to between 1.5 and 2.0.

4. The cleaning roll material according to claim 3, wherein a predetermined amount of a heat-resistant cationic charging agent is attached to said cleaning roll material.

5. The cleaning roll material according to claim 3, wherein said cleaning roll material is impregnated with 3 to 40 g/m$^2$ of silicone oil with a viscosity of 3,000 to 30,000 centistokes or is impregnated with a mixture of the silicone oil and a heat-resistant cationic charging agent.

6. A fixing apparatus comprising a heat roll and a backup roll in a toner image forming apparatus, wherein a first cleaning roll comprising the cleaning roll material according to any one of claims 1 to 3 is wound around a core member and is in contact with said heat roll, and a second cleaning roll comprising a cleaning roll material of a thermally bonded fabric sheet comprising non-plated heat-resistant synthetic fibers and undrawn synthetic fibers is wound around a core member and is in contact with said backup roll.

* * * * *